US008020566B2

(12) United States Patent
Karles et al.

(10) Patent No.: US 8,020,566 B2
(45) Date of Patent: Sep. 20, 2011

(54) APPARATUS FOR DISPENSING A METERED AMOUNT OF LIQUID TO A POROUS PLUG

(75) Inventors: Georgios D. Karles, Richmond, VA (US); Michael Braunshteyn, Richmond, VA (US); Kenneth Newman, Prince George, VA (US)

(73) Assignee: Philip Morris USA Inc., Richmond, VA (US)

( * ) Notice: Subject to any disclaimer, the term of this patent is extended or adjusted under 35 U.S.C. 154(b) by 466 days.

(21) Appl. No.: 12/222,970

(22) Filed: Aug. 20, 2008

(65) Prior Publication Data

US 2009/0165809 A1 Jul. 2, 2009

Related U.S. Application Data

(60) Provisional application No. 60/935,813, filed on Aug. 31, 2007.

(51) Int. Cl.
*A24B 15/00* (2006.01)
*A24D 3/06* (2006.01)

(52) U.S. Cl. ..... 131/331; 131/300; 131/270; 141/329; 141/18

(58) Field of Classification Search ..... None
See application file for complete search history.

(56) References Cited

U.S. PATENT DOCUMENTS

| | | | | |
|---|---|---|---|---|
| 1,632,920 | A | 6/1927 | Patten | |
| 2,333,049 | A | 10/1943 | Shapiro | |
| 2,721,551 | A | 10/1955 | Lobl | |
| 2,764,154 | A | 9/1956 | Murai | |
| 3,319,632 | A | 5/1967 | Burbig | |
| 3,636,959 | A | 1/1972 | Marand | |
| 3,677,269 | A | 7/1972 | Hudson | |
| 4,116,571 | A | 9/1978 | Maxwell | |
| 4,393,884 | A | 7/1983 | Jacobs | |
| 4,569,136 | A | 2/1986 | Loring | |
| 4,714,082 | A * | 12/1987 | Banerjee et al. | 131/359 |
| 4,765,347 | A | 8/1988 | Sansabaugh, Jr. et al. | |
| 5,535,735 | A | 7/1996 | McPherson | |
| 6,161,726 | A * | 12/2000 | Parsons et al. | 222/52 |
| 6,412,494 | B1 | 7/2002 | Bloom, Jr. | |
| 2001/0044603 | A1 | 11/2001 | Harrold | |
| 2004/0231684 | A1 * | 11/2004 | Zawadzki et al. | 131/207 |

FOREIGN PATENT DOCUMENTS

| | | |
|---|---|---|
| EP | 0272852 | 6/1988 |
| WO | WO81/03413 | 12/1981 |
| WO | WO98/02053 | 1/1998 |
| WO | WO03/105614 A1 | 12/2003 |

* cited by examiner

OTHER PUBLICATIONS

International Search Report and Written Opinion mailed May 26, 2009 for PCT/IB2008/003009. International Preliminary Report on Patentability issued Mar. 2, 2010 for PCT/IB2008/003009.

*Primary Examiner* — Richard Crispino
*Assistant Examiner* — Phu Nguyen
(74) *Attorney, Agent, or Firm* — Buchanan Ingersoll & Rooney PC

(57) ABSTRACT

A dispenser for dispensing a metered amount of liquid into a porous plug includes a casing which has an inlet passage adapted to receive a manually insertable porous plug. A reservoir disposed in the cavity contains the liquid. The reservoir has an outlet which is communicable with the inlet passage. A discharge mechanism disposed in the casing is actuable in response to the insertion of a porous plug into the inlet passage for producing a pressurized air flow which bears against a piston in the reservoir for discharging a metered amount of the liquid from the reservoir into the porous plug. The plug could constitute a filter attached to a tobacco column.

16 Claims, 2 Drawing Sheets

APPARATUS FOR DISPENSING A METERED AMOUNT OF LIQUID TO A POROUS PLUG

CROSS-REFERENCE TO RELATED APPLICATIONS

This application claims priority under 35 USC §119 to U.S. Provisional Application No. 60/935,813 entitled METHOD AND APPARATUS FOR DISPENSING A METERED AMOUNT OF LIQUID TO A POROUS PLUG and filed on Aug. 31, 2007, the entire content of which is hereby incorporated by reference.

BACKGROUND

This relates to an apparatus for delivering a metered amount of liquid additive to a porous plug, such as a cigarette filter attached to a tobacco column.

It is known to provide cigarettes with additives such as flavors or sensory stimulants, such as menthol for example, at the time of cigarette manufacture. A shortcoming of such a practice is that the intensity of the additive can fade over time, whereby the benefits to the consumer are diminished and not consistent from cigarette pack to cigarette pack. Also, in the case of additives applied directly to the tobacco, the additive may be burned or pyrolyzed as the cigarette is smoked, whereby its effect is minimized.

Moreover, cigarette filters may contain adsorbents for the removal of gas-phase constituents produced from the burning end of the cigarette. For instance, if menthol is used as the additive in a carbon laden filter, it is possible for the carbon to adsorb the menthol, thus reducing the availability of menthol to the mainstream smoke and also reducing the capacity of the carbon to adsorb the gas phase constituents in the smoke.

Thus, there is a need to maximize the effect of cigarette additives without reducing the capacity of adsorbents to adsorb gas-phase constituents from mainstream smoke.

There is also a need to ensure that the effect of the additive is not diminished before the cigarette is smoked, and be consistent from one cigarette pack to another.

SUMMARY OF PREFERRED EMBODIMENT

There is provided a dispenser for dispensing a metered amount of liquid additive into a porous plug, comprising a casing including an inlet passage adapted to receive a manually insertable porous plug. A reservoir is disposed in the cavity for containing a liquid, the reservoir having an outlet communicable with the inlet passage. A discharge mechanism is disposed in the casing and is actuable in response to the insertion of a porous plug into the inlet passage for discharging a metered amount of the liquid from the reservoir and into the porous plug.

A method of dispensing liquid additive into a porous plug comprises the steps of:

A. inserting a porous plug into an inlet passage of a casing which contains a liquid; and B. causing the force of inserting the plug to pressurize air; and C. directing the air to displace liquid from the reservoir into the porous plug.

DETAILED DESCRIPTION OF PREFERRED EMBODIMENTS

A dispenser is provided for introducing a metered amount of liquid additive into a porous plug to be inhaled by a consumer. For example, a liquid additive such as a flavor, a tobacco extract or an agent to remove smoke constituents can be introduced into a cigarette filter just before the cigarette is smoked. This ensures that: (i) a fresh, consistent flavor or agent is delivered by the cigarette, (ii) there is safeguard against the liquid being pyrolyzed, and (iii) there will be insufficient opportunity for adsorbents in the filter to adsorb the flavor or agent prior to the cigarette being smoked.

Figure 1:
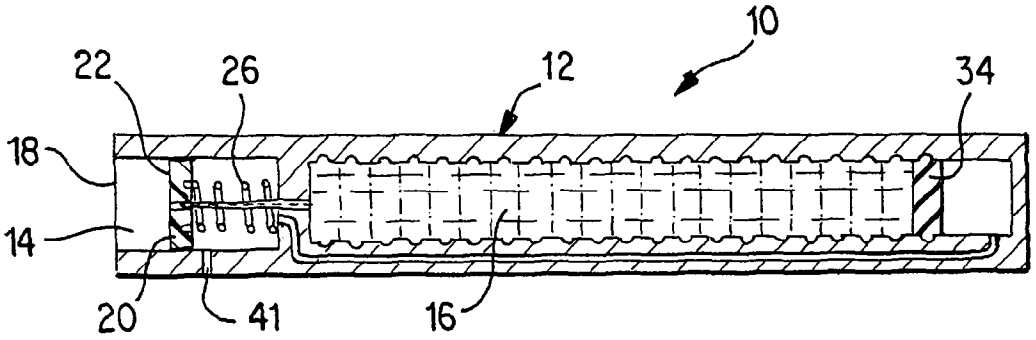
FIG. 1 is a longitudinal sectional view taken through a dispenser according to the present invention, prior to the insertion of a porous plug thereinto.
Figure 2:
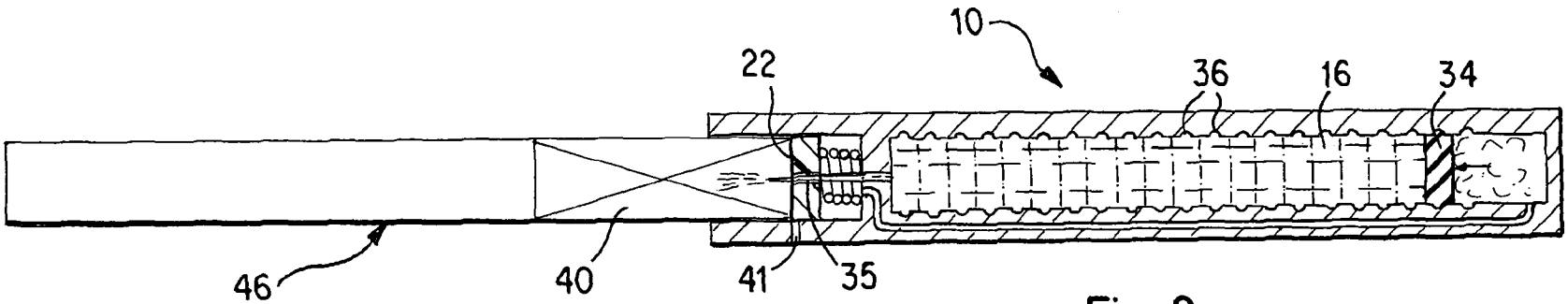
FIG. 2 is a view similar to FIG. 1 after a porous plug has been inserted into the dispenser.
Figure 3:
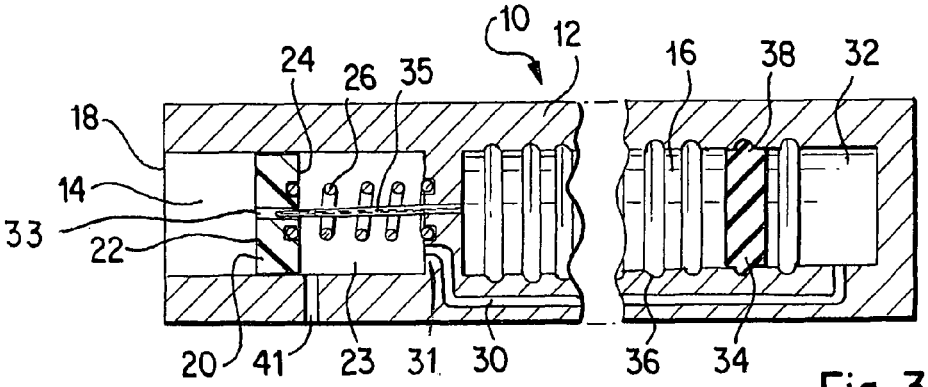
FIG. 3 is an enlarged longitudinal sectional view, shortened in length, of the dispenser according to the invention.

Depicted in FIG. 1 is a preferred dispenser 10 comprising a casing 12 which forms an inlet passage 14 and a liquid reservoir 16. The inlet passage 14 is sized to receive a porous plug that can be inhaled by a consumer. The porous plug could be a cigarette filter 40 attached to a tobacco column 46, as shown in FIG. 2, and the liquid could be a flavor or sensory agent such as menthol.

The casing 12 is generally cylindrical, and the inlet passage 14 includes an open end 18. Disposed in the passage 14 is a plunger 20 which has front and rear sides 22, 24 and is biased toward the open end 18 by a suitable spring, such as a coil compression spring 26. A chamber 23 is formed between a rear surface 24 of the plunger and an end wall 31 of the reservoir. A duct 30 communicates that chamber with a pressurizing end 32 of the reservoir. It will be appreciated that when a porous plug, such as a cigarette filter for example, is inserted into the inlet passage and against the front side 22 of the plunger, the plunger will be displaced rearwardly, (i.e., to the right as shown in FIG. 2). In so doing, the air in the chamber 23 will be pressurized and transferred via the duct 30 to the pressurizing end 32 of the reservoir to pressurize a movable piston 34 located in the reservoir in order to apply a pressurizing force to the liquid in the reservoir.

Preferably, the cylindrical wall of the reservoir includes annular notches 36 spaced equidistantly apart in a direction of piston travel, and the piston 34 includes an annular radially outward projection 38 adapted to fit into the notches. The force of pressurized air from the duct 30 bearing against the rear side of the piston will be sufficient to displace the projection 38 from one notch to the next. Each time that the piston travels to the next notch, a metered amount of liquid is discharged from the nozzle. Thus, the piston traverses the reservoir in stepwise fashion, with the annular projection 38 snapping sequentially into the notches 36 to cause predetermined metered amounts of liquid to be discharged, and to prevent return travel of the piston when the transmission of pressurized air from the plunger 20 ceases.

The reservoir 16 includes a discharge passage formed by a fixed hollow pin such as a hollow needle 35 mounted in the end wall 31. The needle extends through a bore 33 in the plunger, and the plunger is slidable relative to the needle, so that when the plunger is displaced (to the right in FIG. 1) by the insertion of a porous plug as shown in FIGS. 2 and 4, the displacement of the plunger causes the outlet or free end of the fixed needle to pass through the plunger and enter the porous plug 40 to inject into the porous plug the liquid pressurized by the piston 34.

Figure 4:
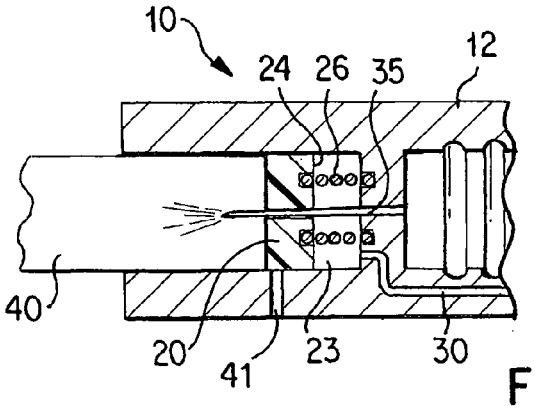
FIG. 4 is a fragmentary view of FIG. 3 after a porous plug has been inserted.

In operation, a porous plug 40 is inserted into the inlet passage 14 and against the plunger 20 (as shown in FIGS. 2 and 4). The plunger is thus displaced toward the end wall 31 of the reservoir (while compressing the spring 26) to inject air through the duct 30 and into the pressurizing end 32 of the reservoir 16 to pressurize the rear end of the piston 34 and displace the piston forwardly toward the inlet 14 until the projection 38 enters the next notch 36 to pressurize the liquid in the reservoir. The pressurized liquid thus travels through the hollow needle 35 which by now has passed through the displaced plunger, and enters the porous plug.

Thus, the step of inserting the porous plug serves to communicate the plug with the reservoir, and the force of such insertion is transmitted via pressurized air to displace liquid from the reservoir.

Once liquid has been inserted into the porous plug, the porous plug is removed, whereupon the compressed spring 26 expands to push the plunger 20 back to its initial position. Such return movement of the plunger 20 is facilitated since air can enter the chamber 23 e.g., through play between the plunger and the wall of the passage 14, or through a very narrow vent 41 formed at an appropriate place in the casing.

The piston 34 stays in its new position in the reservoir because it is held by the engagement of the annular projection 38 within a respective annular notch 36.

If the porous plug is a cigarette filter attached to a tobacco column of a cigarette 46, the liquid may comprise a flavorant such as menthol, or a liquid formulation or agent which acts to selectively remove smoke constituents from main stream smoke.

Figure 5:
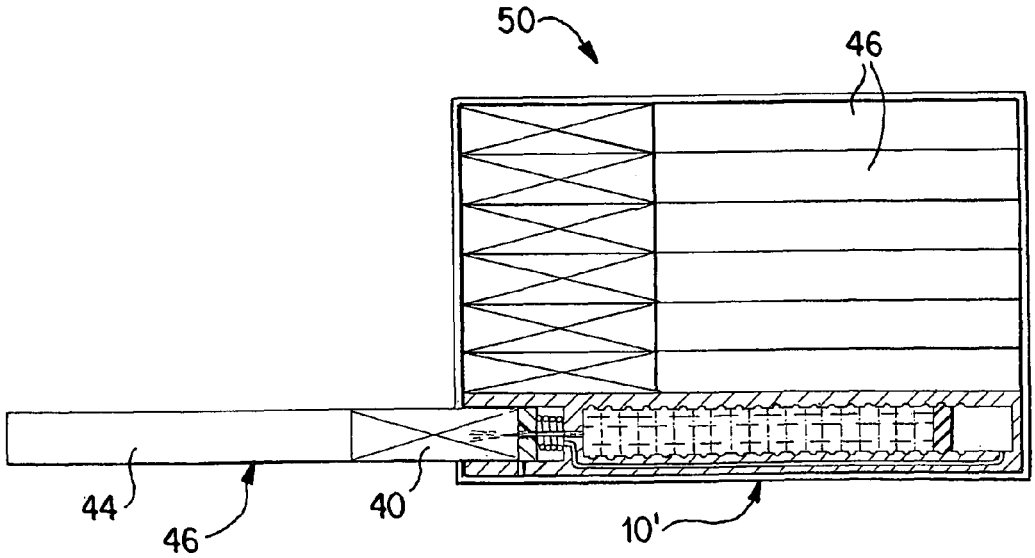
FIG. 5 is a view of an alternative embodiment of the invention where the dispenser is part of a case for storing porous plugs.

The dispenser 10 could comprise part of a larger case 50 which contains a supply of porous plugs, such as filtered cigarettes 46, as shown in FIG. 5.

The dispenser 10 may be utilized without lighting the cigarette or in cooperation solely with a filter plug without the presence of any combustible tobacco.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A dispenser for dispensing a metered amount of liquid into a porous plug, comprising:

a casing including an inlet passage adapted to receive a manually insertable porous plug;

a reservoir disposed in the cavity for containing a liquid, the reservoir having an outlet communicable with the inlet passage;

a discharge mechanism disposed in the casing and capable of being actuated in response to the insertion of a porous plug into the inlet passage for discharging a metered amount of the liquid from the reservoir into the porous plug, and an indexing structure for discharging a metered amount of liquid from the reservoir, the indexing structure including a piston, which traverses the reservoir in a plurality of notches formed in a cylindrical surface of the reservoir and spaced uniformly apart, and wherein the piston snaps sequentially into the notches during insertion of the porous plug into the inlet passage, which discharges the metered amount of liquid from the reservoir into the porous plug.

2. The dispenser according to claim 1 wherein the discharge mechanism is arranged to cause a force of plug insertion to pressurize air, which displaces the piston from one notch to a next notch discharging the liquid from the reservoir.

3. The dispenser according to claim 1 wherein the inlet passage is sized to receive a porous plug in the form of a cigarette filter attached to a tobacco column.

4. The dispenser according to claim 1 wherein the liquid comprises tobacco extracts.

5. The dispenser according to claim 1 wherein the liquid comprises menthol.

6. The dispenser according to claim 1 wherein the liquid comprises an agent for removing a constituent from mainstream smoke.

7. A dispenser for dispensing a metered amount of liquid into a porous plug, comprising:

a casing including an inlet passage adapted to receive a manually insertable porous plug;

a reservoir disposed in the cavity for containing a liquid, the reservoir having an outlet communicable with the inlet passage;

a discharge mechanism disposed in the casing and capable of being actuated in response to the insertion of a porous plug into the inlet passage for discharging a metered amount of the liquid from the reservoir into the porous plug; and wherein the inlet passage is separated from a discharge end of the reservoir by a wall, the inlet passage communicating with the reservoir by a hollow pin mounted in the wall, the discharge mechanism comprising;

a plunger disposed slidably within the inlet passage and forming, together with the wall, an air chamber, wherein air in the chamber is pressurized by displacement of the plunger toward the wall in response to the insertion of a porous plug into the inlet passage, and wherein an outlet end of the pin passes through the displaced plunger into the porous plug, a piston disposed in the reservoir and including a first side facing the wall and second side facing away from the wall, a duct communicating the air chamber with the second side of the piston for causing the pressurized gas to displace the piston toward the wall and discharge liquid into the porous plug through the hollow pin.

8. The dispenser according to claim 7 wherein the discharge mechanism further includes a spring for biasing the plunger away from the wall.

9. The dispenser according to claim 7 wherein the discharge mechanism further includes an indexing structure for defining predetermined incremental displacements of the piston toward the wall during successive insertions of a porous plug into the inlet passage.

10. The dispenser according to claim 9 wherein the indexing structure comprises a plurality of notches formed in a cylindrical surface of the reservoir and spaced uniformly apart in a direction of piston displacement, and a projection on the piston arranged to snap sequentially into the notches.

11. The dispenser according to claim 9 wherein the casing includes a vent for communicating the air chamber with ambient air when the plunger is displaced away from the wall by the spring.

12. The dispenser according to claim 7 wherein the discharge mechanism is arranged to cause a force of plug insertion to pressurize air for discharging the liquid from the reservoir.

13. The dispenser according to claim 7 wherein the inlet passage is sized to receive a porous plug in the form of a cigarette filter attached to a tobacco column.

14. The dispenser according to claim 7 wherein the liquid comprises tobacco extracts.

15. The dispenser according to claim 7 wherein the liquid comprises menthol.

16. The dispenser according to claim 7 wherein the liquid comprises an agent for removing a constituent from mainstream smoke.

* * * * *